US006101954A

United States Patent [19]

Rein et al.

[11] Patent Number: 6,101,954

[45] Date of Patent: Aug. 15, 2000

[54] WORKTOP AND FRAME CONSTRUCTION

[75] Inventors: Russell J. Rein, Northfield; Barry R. Mumm, Minnetonka; Lloyd C. Mollenkopf, Apple Valley, all of Minn.

[73] Assignee: Rosemount Office Systems, Inc., Lakeville, Minn.

[21] Appl. No.: 09/213,802

[22] Filed: Dec. 17, 1998

[51] Int. Cl.[7] ..... A47B 37/00

[52] U.S. Cl. ..... 108/50.02; 108/156; 108/101; 312/140.4; 312/140.3; 312/223.6; 40/607

[58] Field of Search ..... 108/149, 156, 108/157.1, 157.16, 158.11, 158.12, 159, 90, 50.01, 50.02, 91, 161, 180, 151, 101, 186; 312/140.1, 140.2, 140.3, 140.4, 194, 195, 196, 239, 223.3, 223.6, 351.1, 351.3; 248/414, 188.5; 40/607; 52/220.7, 220.1, 783.1, 795.1, 800.1, 802.1, 802.11, 36.1

[56] References Cited

U.S. PATENT DOCUMENTS

| | | | |
|---|---|---|---|
| 795,957 | 8/1905 | Cartland | 108/157.16 X |
| 1,979,843 | 11/1934 | Roos . | |
| 2,163,049 | 6/1939 | Merrill | 108/156 |
| 2,403,839 | 7/1946 | Adolph . | |
| 2,499,668 | 3/1950 | Morgan et al. . | |
| 2,521,596 | 9/1950 | Molla . | |
| 2,656,045 | 10/1953 | Curtis | 108/101 |
| 3,027,214 | 3/1962 | Curatolo | 312/140.4 |
| 3,146,025 | 8/1964 | Heaney . | |
| 3,521,579 | 7/1970 | Stafford . | |
| 3,635,174 | 1/1972 | Ball et al. | 108/161 X |
| 3,645,569 | 2/1972 | Reilly . | |
| 3,672,723 | 6/1972 | Decursu et al. | 108/91 X |
| 3,697,028 | 10/1972 | Nimmo . | |
| 3,737,136 | 6/1973 | Snurr . | |
| 3,741,514 | 6/1973 | Snurr . | |
| 3,851,601 | 12/1974 | Davis . | |
| 3,863,875 | 2/1975 | Olson . | |
| 3,869,993 | 3/1975 | Edlund | 108/101 |
| 3,886,710 | 6/1975 | Krause et al. . | |
| 3,985,083 | 10/1976 | Pofferi . | |
| 4,242,969 | 1/1981 | Checkwood et al. . | |
| 4,361,098 | 11/1982 | Rusch . | |
| 4,388,012 | 6/1983 | Erickson . | |
| 4,615,278 | 10/1986 | Cabrelli . | |
| 4,630,550 | 12/1986 | Weitaman . | |
| 4,848,245 | 7/1989 | Piretti . | |
| 5,035,186 | 7/1991 | Uredat et al. . | |
| 5,075,224 | 12/1991 | Stascheit . | |
| 5,230,491 | 7/1993 | Tseng . | |
| 5,354,025 | 10/1994 | McCaffrey . | |
| 5,711,230 | 1/1998 | Parsons . | |

FOREIGN PATENT DOCUMENTS

| | | | |
|---|---|---|---|
| 442317 | 8/1991 | European Pat. Off. | 108/106 |

*Primary Examiner*—Janet M. Wilkens
*Attorney, Agent, or Firm*—Westman, Champlin & Kelly, P.A.

[57] ABSTRACT

A worktop and frame construction which utilizes a frame body that forms a generally flat, relatively thick panel that has an hour-glass shape in plan view so that in the center of the frame body clearance is provided for knees of a user of the worktop. The frame body is supported on legs that are assembled without using tools by having tapered sockets and mating tapers at the ends of the legs that tightly and securely fit into the tapered sockets. The workstation parts can be easily assembled on site. The frame body is a sandwich construction which has peripheral frame members that form outwardly opening raceways for wiring.

16 Claims, 9 Drawing Sheets

WORKTOP AND FRAME CONSTRUCTION

BACKGROUND OF THE INVENTION

The present invention relates to a worktop and frame construction that provides easy manufacturing and rigidity, while providing modularity for forming a support for various types of needs in a work place. The frame is made so that it assembles easily with a minimum number of components and essentially no tool requirements.

In the prior art, various types of modular worktop and workstation designs have been used, but most of these are difficult to assemble, and difficult to manufacture. The basic requirements of a workstation remain the same, that is, it has to have a work top that is substantially unobstructed, and provide for overhead storage as well as supporting divider panels or worktop screens, in order to meet present requirements. Further there is a need for carrying and concealing electrical and communication lines in an inconspicuous manner in the workstation.

Additionally, various assembly techniques have been used, but they all require several tools for assembly.

SUMMARY OF THE INVENTION

The present invention relates to a modular worktop and frame assembly that is rigid and sturdy and easy to assemble without tools of any type. The worktop support comprises a frame body that is flat, and formed as a "sandwich" construction, for rigidity and light weight. The frame body includes tapered sockets at the corner that will receive and lock in legs for the frame base.

The rear legs are provided with extension tubes or parts that project above the worktop to support shelves, cabinets and the like. Threadless fasteners for supporting panel legs on the extension tubes or posts are provided. These fasteners comprise elongated pins that will support a panel or divider above the worktop and they are held in place with snap-on spacers that lock the pins from axial movement. The worktop is fastened in place by utilizing key hole lock tabs so that the worktop does not have to be screwed into place.

The sandwich construction for the frame body includes a perimeter channel frame that is recessed inwardly between upper and lower panels. The recesses in the frame provide raceways for communication and electrical wiring. The channels open outwardly, and are covered with snap-in plastic covers to cover the wires and for decorative purposes.

The tapered leg holding sockets are formed in the frame, and will securely hold tapered sections of legs for supporting the worktop. The legs can be installed without additional tools, and are stable without cross braces.

The legs also can be adjustable in height utilizing telescoping tubes and pins for pinning the telescopes at different heights, and casters also are easily provided at the bottom of the legs.

When a cabinet is to be supported, threaded pins will be used to hold a cabinet in place, but where dividers are utilized, the plastic spacer lock panel support pins eliminate the need for threaded fasteners and tools.

In a plan view, the frame base has an "hour glass" shape that provides knee clearance for the user, while providing adequate support at the outer side edges of the worktop.

DETAILED DESCRIPTION OF THE PREFERRED EMBODIMENTS

Figure 1:
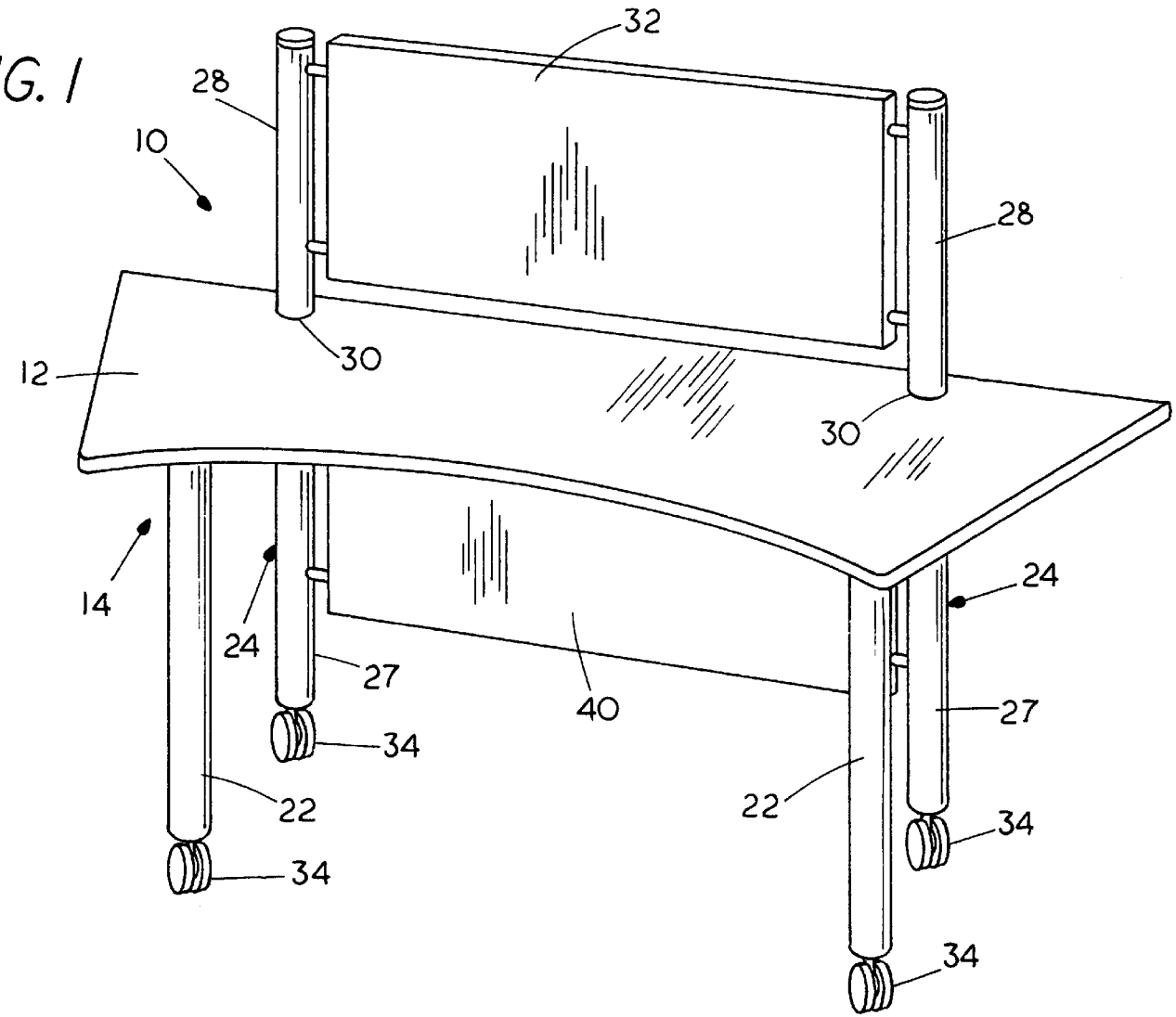
FIG. 1 is a perspective view of a typical workstation having a worktop frame made according to the present invention.
Figure 2:
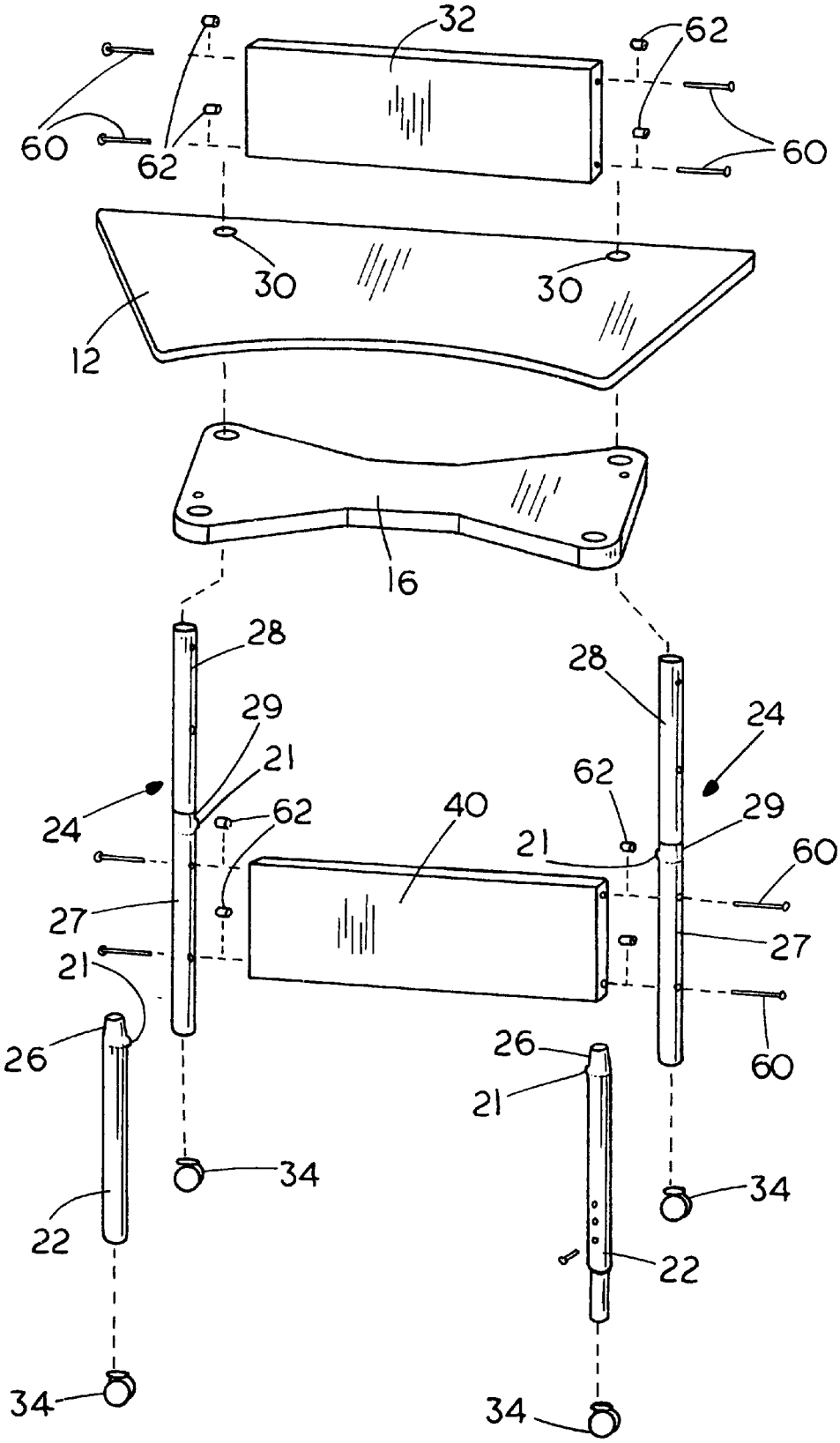
FIG. 2 is an exploded view of the workstation FIG. 1.
Figure 3:
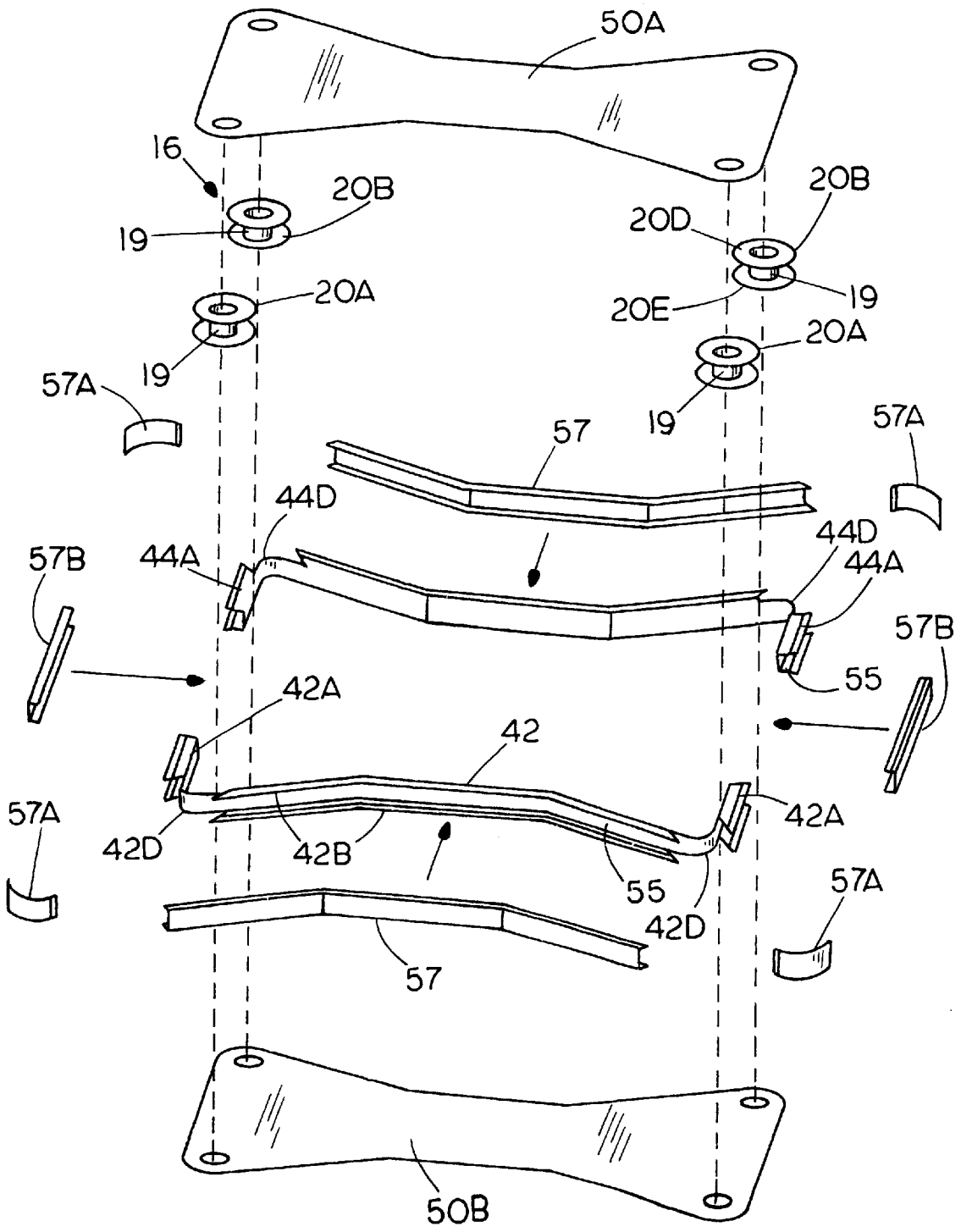
FIG. 3 is an exploded view of the frame top body for the workstation shown in FIG. 1.

A workstation indicated generally at 10 includes a worktop 12 that is supported onto a frame assembly shown generally at 14, shown in an exploded view of FIGS. 2 and 3. The frame assembly 14 includes a frame body 16 that supports the worktop and holds it in place, using keyhole locks, that slide into place. The frame body 16, as shown, is an "hour glass" shape with end portions 18A and 18B that have a greater front to rear length than the center portion 18C so that there is clearance in the center of the frame body for a user's legs without bumping the frame body. The front and rear edges are smoothly curved inwardly from the corners. The frame body 16 includes tapered sockets 20A at the front end, and 20B at the rear of the worktop. The sockets taper to become smaller in upward direction. They are of size so that they will receive front legs 22, and rear leg assemblies 24. The front legs have tapered sections 26 at the upper ends that fit within the tapered sockets 20A and 20B, and tighten down as they mate together.

The rear leg assemblies include lower legs 27 that have tapered sections 29 at the top of the legs that fit into the rear corner sockets and tighten down. The legs, both front and rear, are tubular, and the rear legs 27 have extension posts 28 telescoped into the legs 27. The extension posts 28 extend up through provided openings 30 at the rear of the worktop 12, and as will be explained, the upright extending posts are used for mounting a divider panel or insert 32, or in some forms, cabinets, shelves, or the like. Casters or levelers shown at 34 are provided at the bottom ends of both the front and rear legs.

A modesty panel 40 can be placed between the lower portions of the rear legs, and supported in place in the same manner as the divider panel 32.

Figure 4:
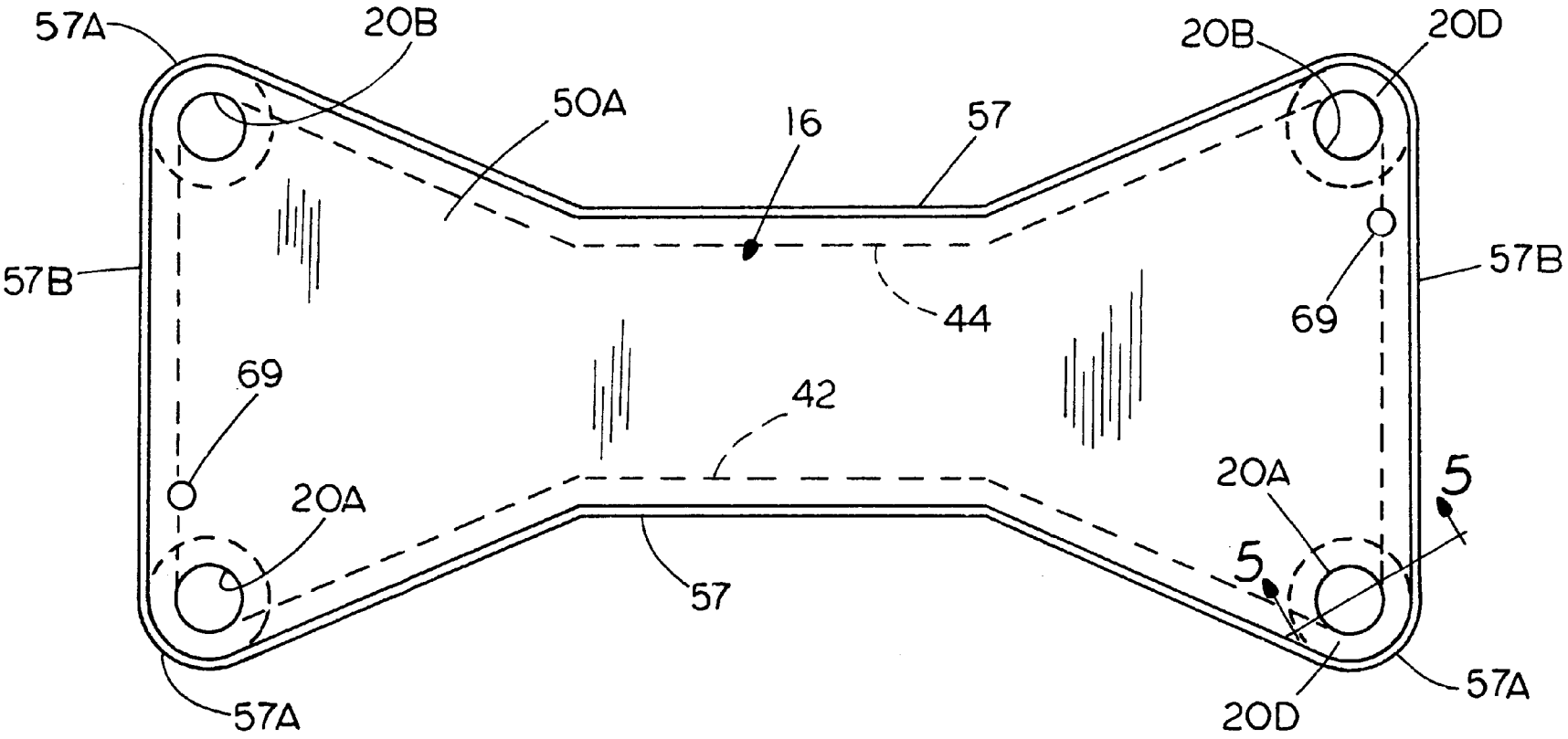
FIG. 4 is a top plan view of a frame body of the present invention.
Figure 5:
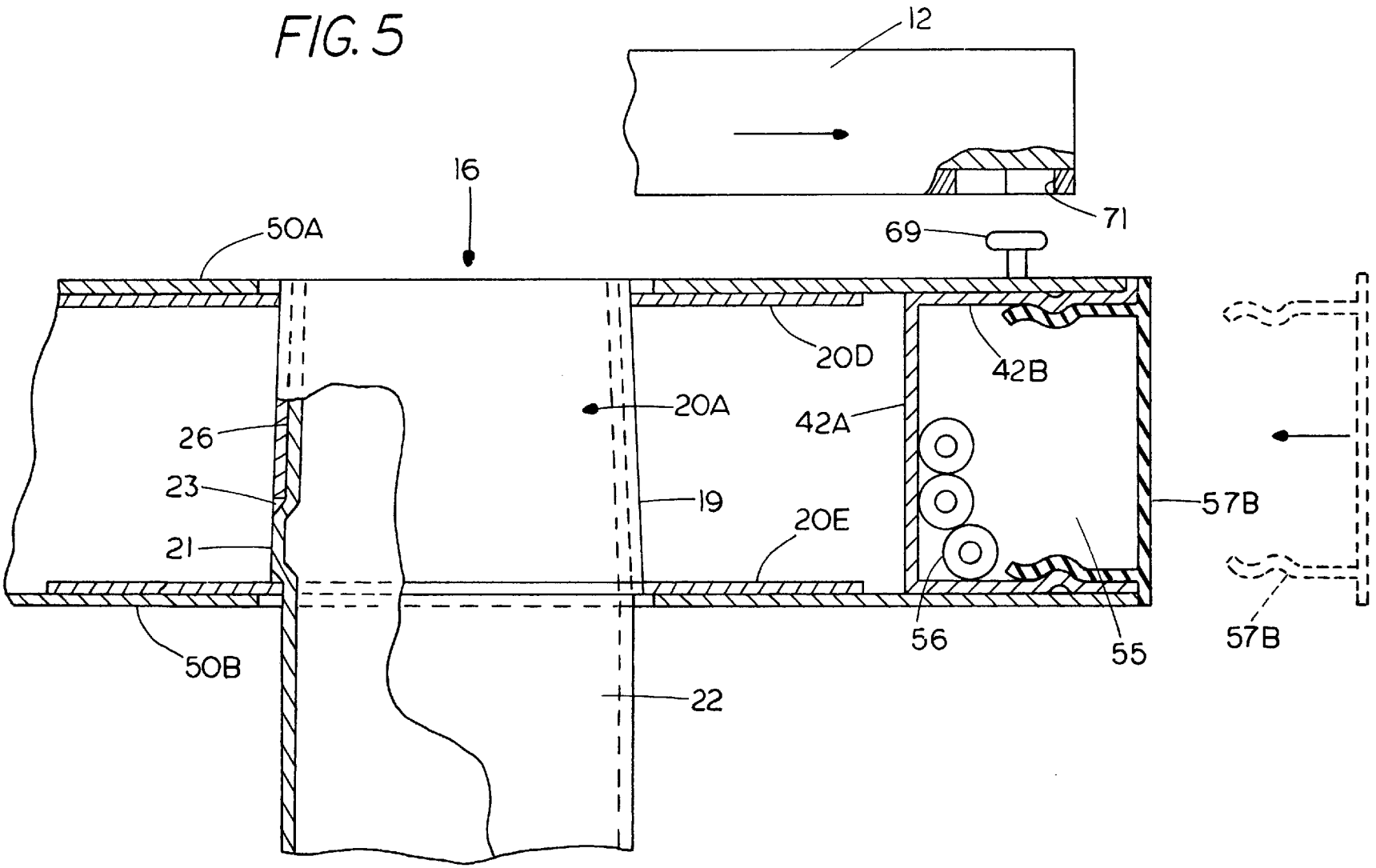
FIG. 5 is a fragmentary enlarged vertical sectional view of one corner of the frame body shown in FIG. 2 in an assembled condition.
Figure 12:
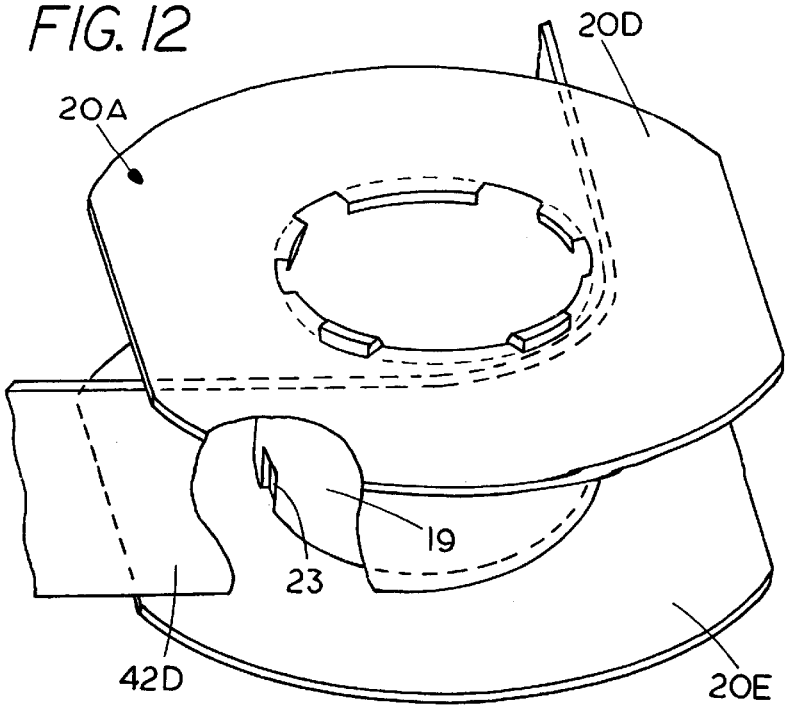
FIG. 12 is a perspective view of a corner structure for the frame body.

The frame body 16, which comprises the main support for the worktop, is shown in a layered exploded view in FIG. 3, and in top views and fragmentary cross section in FIGS. 4 and 5. The frame body 16 is a composite assembly of a pair of extruded channels 42 and 44, which form the front and rear sides, respectively, and side edges are from side flanges 42A and 44A. The flanges 42A and 44A abut together. At each of the front corners of the frame, a tapered bore leg support spool or socket 20A is secured and at the rear corners tapered bore leg support spools or sockets 20B are provided. The tapered bore sockets or spools are on the interior of the corner portions of the frame channels. The corner portions are vertical straps 42D and 44D since the channel flanges are cut away at the frame corners. The straps 42D and 44D are wrapped around the center sleeves of the spools as shown in FIG. 12, and the flanges 20D and 20E extend out as far as the channel flanges at the corners. The straps 42D and 44D are radiused to fit and form the junction between the side and main lateral portions of the frame channels 42 and 44.

Top and bottom frame body panels 50A and 50B are then placed into the assembly, and are secured in place with suitable adhesives so that they are bonded directly to the flanges 42B and 44B at the top and bottom of the frame members 42 and 44, which are channel shaped as shown in FIG. 5, and also are bonded to top and bottom flanges 20D and 20E (FIG. 5) on each of the corner tapered leg support socket spools 20A and 20B. When the adhesive sets, the assembly forms a very rigid, hollow center frame body.

The corner spools have center sleeves 19 that have the tapered bores, which receive and hold the tapered ends 26 of the front legs. As can be seen in FIG. 5, the tapered ends 26 slide in to the bore far enough so that there is a good sturdy support in the tapered spool interior surface that mates the taper on the leg. This provides a rigid support at the front spools.

Figure 6:
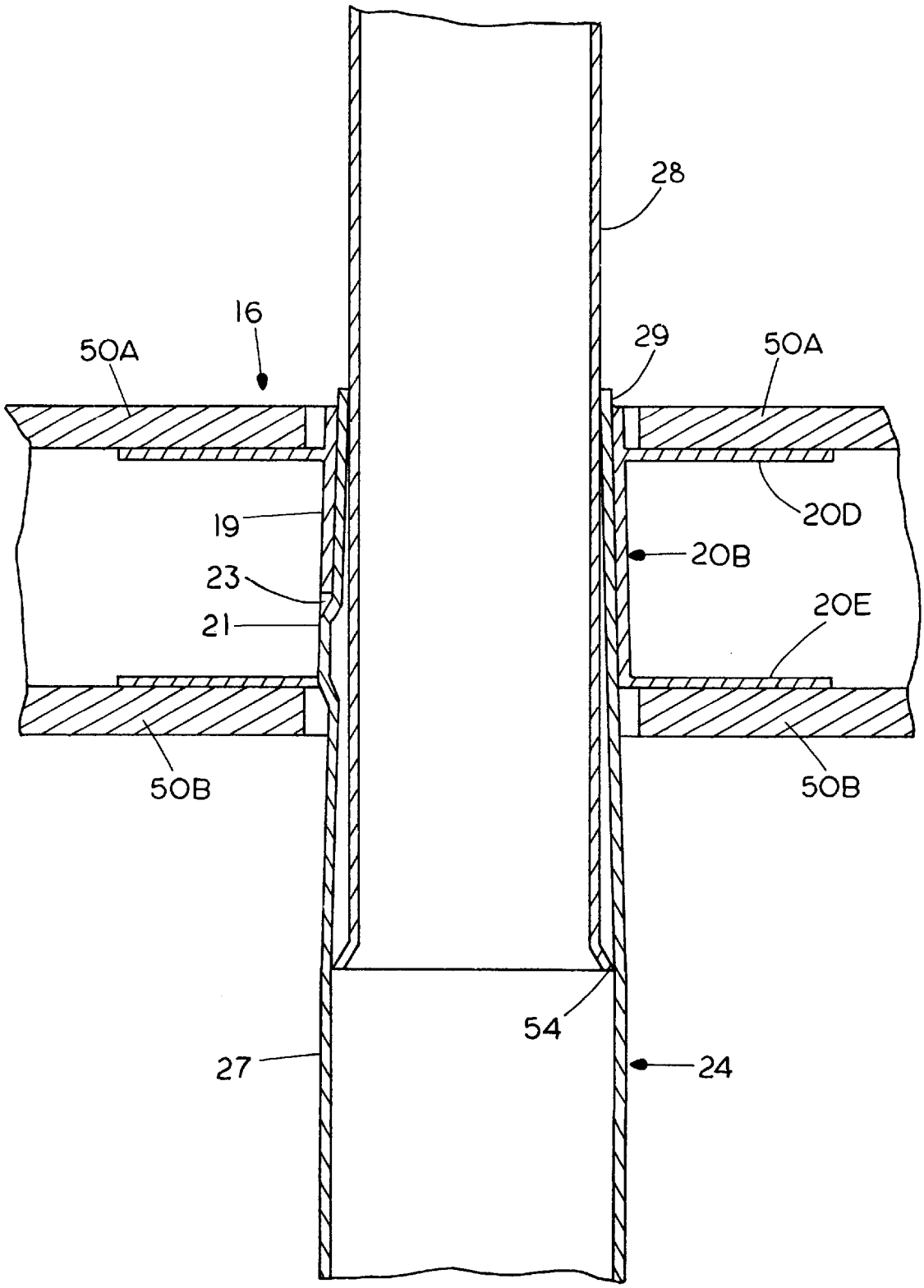
FIG. 6 is a fragmentary sectional view of a rear leg and an upper extension post mounted in a frame body of the present invention.

The rear leg assemblies 24 include the legs 27 and extension ports 28 that extend up through the opening in worktop. The rear legs 24 have tapered ends 29 that fit within the bores of sleeves 19 of the rear spools 20B, with a mating tapered surface. Thus, the legs 27 are securely held to rigidly support the frame base. As shown in FIG. 6, the extension post 28 is slipped inside the tubular lower leg portion 27, and as can be seen, the lower end of the post 28 is flared outwardly at 54 so that it slides against the inner surface of the lower leg 27. The tapered end 29 will tighten down onto the upper end of the upper post 28, as the tapered end 29 fits into the spool 20B. The legs 27 fit very tightly into the rear spools 20B and support the frame body 16 stably. This provides a very rigid, stable support for the extension posts 28. The legs 27 and posts 28 will be tack welded together so they do not rotate relative to each other.

The legs 22 and 27 have alignment tabs 21 extruded out from the legs at a known location at about the start of the taper 26 or 29. The tabs 21 fit into notches 23 in the spools (see FIGS. 2, 5, 6 and 12) for alignment of the openings or bores through the legs and extension tubes that are used for supporting a top cross panel or modesty panel.

As was mentioned, the frame channels 42 and 44 have outwardly opening recesses that form raceways or chambers shown at 55 in FIG. 5, as well as in FIG. 3, between the upper and lower flanges 42B and 44B at the rear. In FIG. 5, raceways are shown holding communication wires shown schematically at 56. The top and bottom flanges 20D and 20E of the corner spools are attached to sleeve 19 and extend out from the straps 42D and 42E forming the corners of the frame and the space between the flanges 20D and 20E form a corner raceway, as can be seen in FIG. 12. The open sides of the frame channels, between the flanges 42B and 44B, and the outwardly open corner raceway areas formed by the spools 20A and 20B are covered with snap-in covers shown at 57, 57A and 57B in FIG. 3. The flanges of the spools 20A and 20B support the cover sections 57A for the corners, and covers 57B for the sides. These covers snap in place to cover the wires 56 that are shown in the raceway 55. The corners can have openings so that the communication wires can be threaded down one of the legs to the floor outlets, or laterally to wall outlets. This keeps the wire management very neat, because the covers snap in place easily. The covers 57 can be provided with openings for outlets or jacks as well. Outlet boxes can be mounted on the channels, if required. The outer position of the snap-in cover is shown in dotted lines in FIG. 5.

Figure 7:
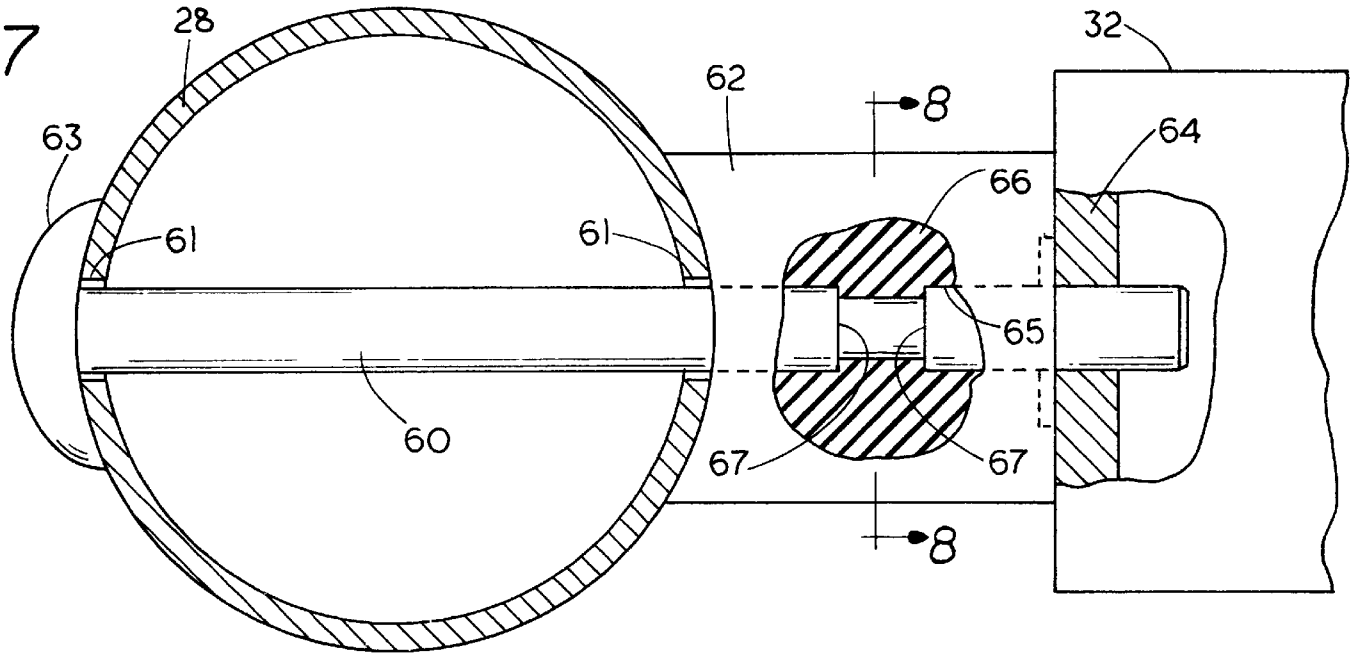
FIG. 7 is a top view of a holding pin and spacer used for holding a divider panel in place on one of the upright extension posts.
Figure 8:
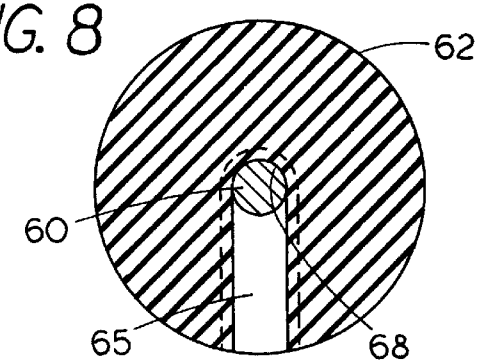
FIG. 8 is a sectional view taken as on line 8—8 in FIG. 7.

The divider panel 32 is supported onto the upper extension posts 28 in a unique way. The extension posts 28 which extend through holes in the work top 12 each have cross bores 61 therein as shown in FIG. 7, and a pin 60 that has a head 63 with a concave inner surface that fits around the outside of the exterior post 28 extends through the bores 61 and through a passage 65 in a saddle shaped, snap-on spacer 62. The pins 60 extend through aligning openings in an edge frame member 64 of the panel 32, so that the pins 60 will support the weight of the divider panel 32. Each pin 60 is held in place tightly against the post with the snap-in spacer 62. Each pin has a necked down groove 66 that forms shoulders 67. The passage 65 of the spacers have smaller sized sections 68 that will fit over the necked down portion 66 to prevent axial movement of the pins 60 in either direction since the section 68 will abut the respective shoulders 67. The snap-in spacer 62 used for locking the support pins 60 in place is adequate support for the inserts, and for the modesty panels that go below the worktop. Panels therefore also can be installed without tools.

The worktop can be fastened onto the frame body using keyholes formed in a keyhole insert 69 on the worktop (see FIGS. 4 and 5) that fits over protruding headed pins 71 on the frame body. The head of the pin that will slip into the large part of the keyhole slots 69A on the inserts 69 and lock in place when the worktop is slid laterally for locking the keyhole slots 69A are not shown in plain view.

Figure 9:
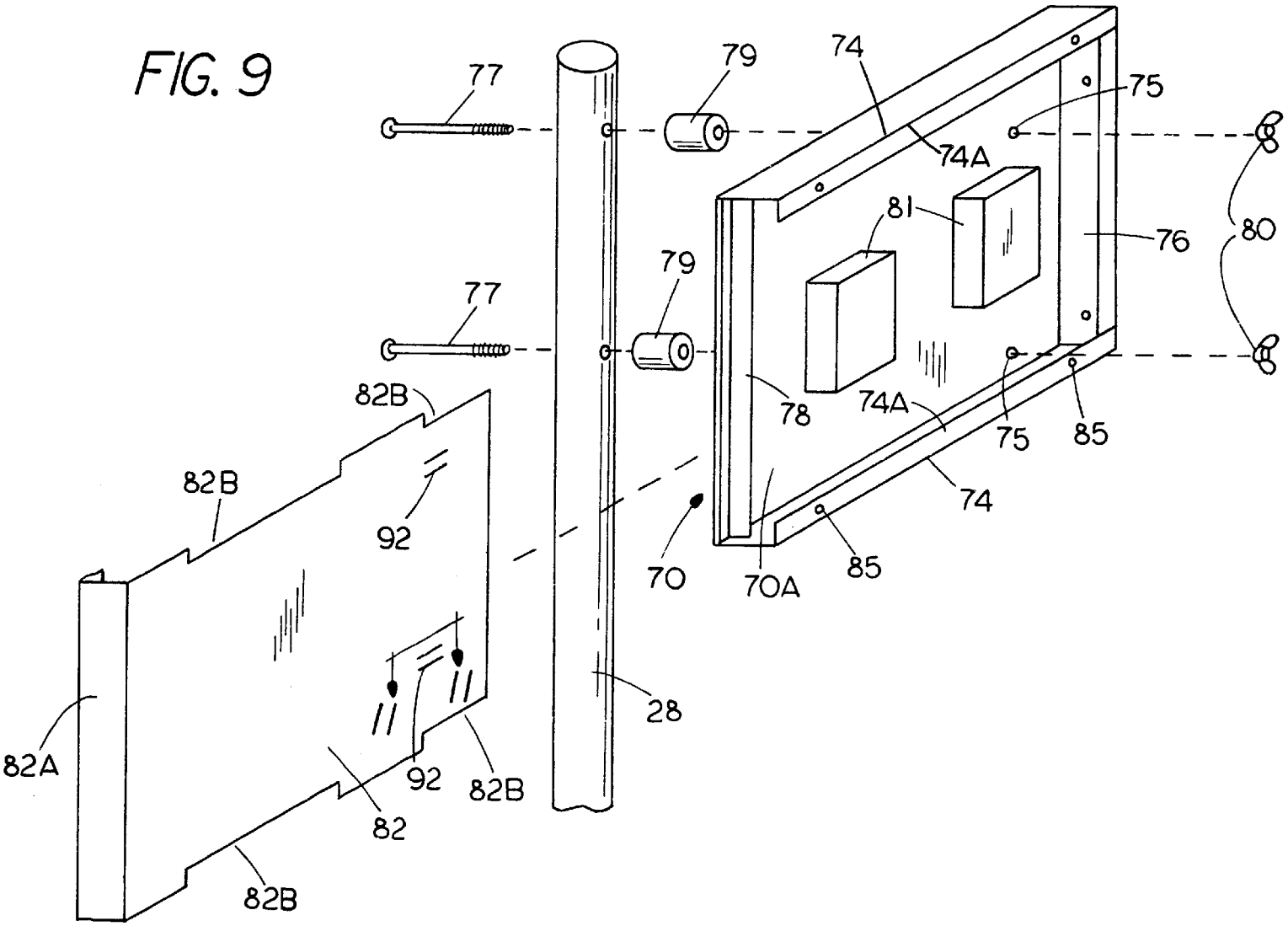
FIG. 9 is an exploded view of an upper cabinet and for mounting on an upper extension post at the rear of the workstation.

Referring to FIG. 9, an exploded view of a cabinet end panel and a support post as illustrated. In this instance, end panel 70 has a wall 70A that is provided with top and bottom channel shaped members 72 and 74 that have legs 72A and 74A that face each other, and a rear upright flange 76. The front end has a stop flange 78, which extends partially across the base of the channels 72 and 74, and is set back from the front edge.

Apertures 75 are provided in the end panel and they are made to receive threaded fasteners, in this form of the invention, indicated at 77 which extend through provided apertures in the upright posts 28 and suitable spacers 79 are provided on the threaded fasteners 77 so that when the fasteners extend through the openings 75, the wall 70A of end panel 70 is spaced from the post 28 a selected distance as determined by the spacer. The spacers 79 can be similar to the spacer 62 or can be a spacer with a through hole for the fastener 77.

The fasteners 77 are secured with wing nuts 80 that thread onto the fasteners and can be finger tightened in place to hold the end panel 70 securely on the respective posts 28.

Additionally, there are spacer blocks 81 mounted onto the interior surface of wall 70A and used for spacing a sliding cover 82 which slides inside the flanges of the channel 72 and 74 to cover the interior of the end panels. A front flange 82A on the cover 82 provides a finished look at the front of the cabinet and it fits to the front of flange 78.

The front flange 82A of cover 82 is positioned on the inside of the flanges 72A and 74A of the channels 72 and 74, and as can be seen, the cover slides inside the flanges 72A and 74A when assembled.

Figure 10:
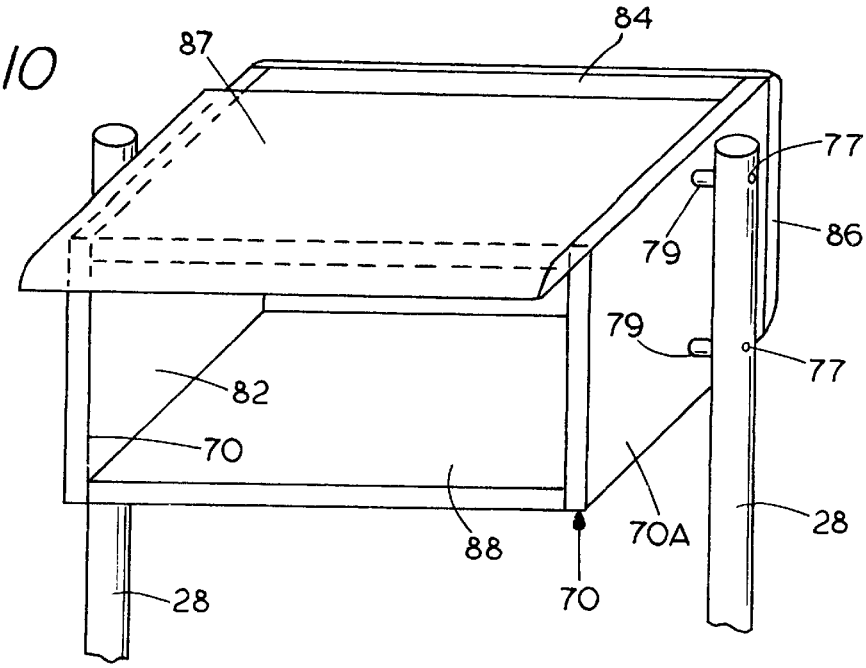
FIG. 10 is a perspective view of a flip top cabinet using end panels mounted as shown in FIG. 9.

When a cabinet is assembled in a cabinet assembly 91, there are two end panels 70, one supported on each of the upright posts 28 of the worktop, and then top, rear and bottom walls are put into place as shown in FIG. 10, with the top wall 84, the rear wall 86 and the bottom wall 88 fastened in place on the pair of end walls 70 with suitable pop rivets using apertures shown at 85 in FIG. 9. The top wall 84 can have downwardly depending flanges that mate with the flanges 72A of the channels 72, and the bottom wall 88 also can have downwardly depending flanges that mate with the flanges 74A of channels 74 and use the apertures 85 for riveting. A panel that mates with the back side of the flanges 76 of the end panels, and the rear wall can be pop riveted into place.

A door 87 is used and mounted in a suitable known manner. It can be in its open position as shown in FIG. 10, or closed to cover the front opening of the cabinet assembly 91.

Thus, the upright posts 28 are be used for supporting cabinets or shelves. The cabinet can be pre-assembled prior to putting it into place on the upright posts 28. The covers 82 would be removed, and then the threaded fasteners can be passed through the apertures 75, the wing nuts 80 installed, and tightened up to hold the cabinet in place and then the covers 82 can be slid into place. The covers 82 would have to slide past the pop rivets when the cabinets are pre-assembled. There are notches 82B at the bottom and top of cover 82 to provide pop rivet clearance.

Figure 11:
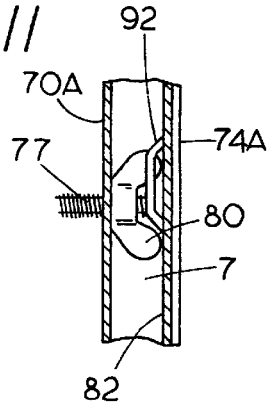
FIG. 11 is a sectional view through a wall of the cabinet assembly to illustrate a method of holding a wingnut on a fastener from turning once a wall of the cabinet is assembled.

The covers 82 may be provided with a partial punch out tab or web 92, as shown in FIG. 11. The web 92 will be of a size to protrude far enough to engage the respective wing nut 80 after it is tightened onto a threaded fastener 77, and prevent the wing nuts 80 from loosening once the cover 82 is slid into place.

An interior chamber is formed between the cover 82 and the wall 70A of the end panel 70 as defined by the spacers 81.

The worktop and frame construction of the present invention is thus conFIG.d for convenience, is stable and yet can be assembled and disassembled with no tools even when an upper cabinet is used.

The hour-glass shaped frame base ensures that extra clearance is present for the users needs in the center portions of the worktop where the frame base is located, and the use of the sandwich construction with the adhesively secured tapered bore sockets or spools provides a very rigid leg support without having braces or without needing tools for assembly.

Although the present invention has been described with reference to preferred embodiments, workers skilled in the art will recognize that changes may be made in form and detail without departing from the spirit and scope of the invention.

What is claimed is:

1. A support frame body for a workstation worktop comprising a generally flat body having end portions that extend in front to rear directions a greater distance than center portions, the frame body having a substantially continuous perimeter and having leg supports at corners thereof, said frame body comprising a sandwich construction having perimeter frame members, and top and bottom panels secured to the frame members, and to the corner leg supports.

2. The support frame body of claim 1, wherein said leg supports comprise tapered bore socket spools having top and bottom flanges that are secured to the top and bottom panels forming the frame body.

3. The support frame body of claim 2 wherein a pair of legs are provided in the leg supports on a rear side of the frame body, a pair of support extension posts telescopically mounted in such legs, said extension posts extending upwardly from the frame body, a worktop supported on said frame body having openings for the extension posts to pass therethrough, said legs being tubular and having an interior surface, and the extension posts each having a flared end that is tightly slidably fitted on the interior surface of a respective leg and which flared ends are spaced downwardly from upper ends of the legs in use to provide a stable support for the extension posts extending above the worktop.

4. The support frame body of claim 3 and a housing supported on the extension posts having end panels with apertures therein, threaded fasteners passing from the posts through the apertures, wing nuts for threading on the fasteners on an interior side of each of the end panels for securing the end panels, and a separate cover sliding on the interior of the housing adjacent and spaced from each end panel and having a stop portion adjacent the wing nuts for engaging the wing nuts on the fasteners for the respective end panel when the wing nuts tend to turn on the threaded fasteners.

5. The support frame body and worktop of claim 3 wherein one of the frame body and worktop has key hole slots, and the other of the frame body and worktop has pins mounted thereon, the worktop being supported on the frame body and the pins interlocking with the keyhole slots and holding said pins in position.

6. The support frame body of claim 1 wherein said perimeter frame members comprise channel cross section shapes on at least major portions of a periphery of the frame body, said channel cross section shapes having upper and lower flanges and opening outwardly from the frame body to define raceways along substantial portions of the frame body.

7. The support frame body of claim 6 and snap-in covers engaging the upper and lower flanges of the channel cross section shape perimeter frame members form enclosed raceways for holding wiring.

8. A workstation assembly comprising a frame body forming a generally flat support having an hour-glass shape in plan view, a worktop mounted on said frame body, said frame body being supported on a plurality of legs, a pair of extension posts on a back side of said worktop extending above said worktop, a panel extending between the pair of extension posts and being shorter upwardly than the extension posts, smooth shanked pins passing through each of the extension posts toward the space between the extension posts and engaging openings in an adjacent end of the panel, and spacers having passages fitting over the smooth shanked pins between the panel and the respective extension post, said pins each having an annular groove defined therein between the respective extension post and the panel, and the passage of each spacer having a reduced sized portion that slips into the groove of its associated smooth shanked pin and locks the associated pin from axial movement.

9. The assembly of claim 8 wherein said spacers comprise a saddle shaped member and each passage comprising a longitudinally extending passage that opens to one side of the respective spacer.

10. The assembly of claim 8 wherein said pins have heads with surfaces facing the extension posts that are configured to form to the outer surfaces of said extension posts, said extension posts being generally cylindrical tubes.

11. The assembly of claim 8 wherein said frame body has four socket members with tapered interior bores at support corners thereof, and said legs having a corresponding taper that fits within one of the tapered bores, respectively, and which tapers tighten down from weight acting vertically downward on the frame body.

12. A workstation assembly comprising a frame body forming a generally flat support having an hour-glass shape in plan view, a worktop mounted on said frame body, said frame body being supported on a plurality of legs, a plurality of spool socket members, one for each leg, mounted relative to the frame body, the spool socket members having tapered bores, and said legs each having tapers at an upper end that fits within one of the tapered bores, respectively, the tapers tightening into the socket members from weight acting vertically downward on the frame body.

13. The workstation assembly of claim 12 wherein said frame body comprises a sandwich construction having peripheral frame members, with top and bottom flanges, the spool socket members having top and bottom spool flanges, and top and bottom wall panels adhesively secured to the flanges of the frame members, and to the spool flanges.

14. The workstation assembly of claim 13 wherein the flanges of said peripheral frame members are spaced apart to form outwardly opening raceways, and the spool flanges aligning with frame member flanges to form raceway portions at corners of the frame body.

15. The workstation assembly of claim 14 and snap-in covers engaging the top and bottom frame flanges and the spool flanges to form enclosed raceways for holding 0wiring.

16. A workstation assembly comprising a generally flat frame body having end portions that extend in front to rear directions, the flat frame body having leg supports at corners thereof, a leg mounted on each of the leg supports including a pair of rear legs on a rear side, a pair of telescoping extension posts, one mounted in each of the pair of rear legs, said extension posts extending upwardly through the flat frame body, a worktop supported on said flat frame body and having openings for the extension posts to pass therethrough, said pair of rear legs being tubular and having an interior surface, and the extension posts having flared ends that are tightly slidably fitted on the interior surface of the posts, respectively, and wherein the flared ends are spaced downwardly from upper ends of the rear legs in use to provide a stable support for the extension posts extending above the worktop.

* * * * *

UNITED STATES PATENT AND TRADEMARK OFFICE

CERTIFICATE OF CORRECTION

PATENT NO. : 6,101,954
DATED : August 15, 2000
INVENTOR(S) : Russell J. Rein et al.

It is certified that error appears in the above-identified patent and that said Letters Patent is hereby corrected as shown below:

Under the Section "OTHER DOCUMENTS", add the following citiation:
--Brochure of Hafele, "Idea Table Support System", published 1/1997, pages 1-7

Column 8,
Line 8, cancel "0".

Signed and Sealed this

Nineteenth Day of June, 2001

*Attest:*

Nicholas P. Godici

*Attesting Officer*

NICHOLAS P. GODICI
*Acting Director of the United States Patent and Trademark Office*